United States Patent [19]

Glass et al.

[11] Patent Number: 4,567,071

[45] Date of Patent: Jan. 28, 1986

[54] FAST-HEATING CATHODE

[76] Inventors: Erich Glass, Lindenweg 38, 8056 Neufahrn; Hinrich Heynisch, Im Birket 7, 8032 Gräfelfing, both of Fed. Rep. of Germany

[21] Appl. No.: 625,720

[22] Filed: Jun. 28, 1984

[30] Foreign Application Priority Data

Jun. 29, 1983 [DE] Fed. Rep. of Germany ..... 3323473

[51] Int. Cl.[4] ..... H01J 1/14

[52] U.S. Cl. ..... 428/35; 313/345; 313/346 R; 313/346 DC

[58] Field of Search ..... 313/345, 346 R, 346 DC, 313/311; 428/35

[56] References Cited

U.S. PATENT DOCUMENTS

| | | | |
|---|---|---|---|
| 3,333,141 | 7/1967 | Lemmens et al. | 313/345 |
| 3,385,997 | 5/1968 | Vitzthum | 313/346 R |
| 3,775,116 | 11/1973 | Takemoto et al. | 96/36.1 |
| 4,215,180 | 7/1980 | Misumi et al. | 313/311 |
| 4,310,777 | 1/1982 | Fukushima et al. | 313/346 R |
| 4,313,854 | 2/1982 | Sunahara et al. | 313/346 R |
| 4,349,766 | 9/1982 | Ando et al. | 313/345 |
| 4,471,260 | 9/1984 | Hasker et al. | 313/345 |

FOREIGN PATENT DOCUMENTS

| | | |
|---|---|---|
| 2160145 | 6/1974 | Fed. Rep. of Germany . |
| 2904653 | 6/1981 | Fed. Rep. of Germany . |

*Primary Examiner*—John E. Kittle
*Assistant Examiner*—James J. Seidleck
*Attorney, Agent, or Firm*—Herbert L. Lerner; Laurence A. Greenberg

[57] ABSTRACT

Directly heated oxide cathode especially for velocity-modulated tubes in pulse operation, characterized by the features that an outer conductor is designed cylindrically and an inner conductor is coaxially arranged by means of a ceramic support disc, and that on one end face, a metal layer connected to the outer conductor and the inner conductor is provided with an electron-emitting oxide layer.

16 Claims, 1 Drawing Figure

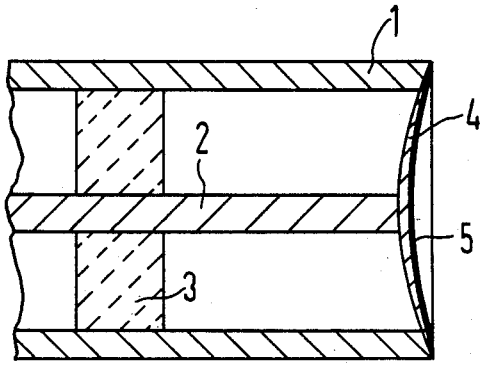
1
2
3
4
5

FAST-HEATING CATHODE

BACKGROUND OF THE INVENTION

1. Field of the Invention

The invention relates to a directly heated oxide cathode, especially for velocity-modulated tubes in pulse operation.

2. Description of the Prior Art

Directly heated oxide cathodes are known, for instance from German DE-AS No. 21 60 145 (U.S. Pat. No. 3,775,166) and German DE-AS No. 29 04 653 (U.S. Pat. No. 4,215,180). Such oxide cathodes consist essentially of a cathode body (base metal plate) of a high-resistivity alloy and an electron-emitting layer. The base metal plate is designed in the shape of a yoke. The oxide layer is applied to the outside of the flat part of the base metal plate. At the ends of the base metal plate facing away therefrom, are provided leads for the d-c voltage souce.

SUMMARY OF THE INVENTION

An object of the invention is to provide a directly heated oxide cathode especially for velocity-modulated electron tubes which is distinguished by a very short heating-up time.

With the foregoing and other objects in view, there is provided in accordance with the invention a directly heated oxide cathode, especially for velocity-modulated tubes in pulse operation, which comprises cylindrical outer conductor, an inner conductor coaxially arranged within the cylindrical outer conductor, a ceramic support disc supporting and spacing the inner conductor from the outer conductor, a metal layer connected on one end face of the cathode to the outer conductor and the inner conductor, and an electron-emitting oxide layer disposed on the layer plate.

Other features which are considered as characteristic for the invention are set forth in the appended claims.

Although the invention is illusrated and described herein as embodied in a fast-heating cathode, it is nevertheless not intended to be limited to the details shown, since various modification may be made therein without departing from the spirit of the invention and within the scope and range of equivalents of the claims.

BRIEF DESCRIPTION OF THE DRAWING

The invention, however, together with additional objects and advantages thereof will be best understood from the following description when read in connection with the accompanying drawing in which is diagrammatically illustrated in cross-section, a directly heated oxide cathode having a cylindrical outer conductor, an inner conductor coaxially arranged, a non-conductor, ceramic support disc which fastens the inner conductor to the outer conductor, a thin metal layer, preferably nickel, soldered to the inner conductor and the outer conductor at one end face of the cathode, and an electron-emitting oxide layer, e.g. barium oxide layer, applied to the outside of the metal layer.

DESCRIPTION OF THE PREFERRED EMBODIMENTS

The invention relates to a directly heated oxide cathode. This cathode is to have a very short heating-up time. To this end, the invention provides that the cathode have an outer conductor which is cylindrical and in it, an inner conductor is coaxially arranged by a ceramic support disc, and that a metal layer is provided which is connected on one end face to the outer conductor and the inner conductor and that the metal layer is provided with an electron-emitting oxide layer. The oxide cathode according to the invention is used particularly in velocity-modulated tubes in pulse operation. The metal layer as well as the inner conductor and the outer conductor preferably consist of nickel or a nickel alloy. The oxide layer may be an alkali metal oxide or an alkaline earth oxide layer which, when directly heated in a cathode, emits electrons. The metal layer thickness is substantially less than the thickness of the wall of the outer conductor or the inner conductor to obtain rapid heating of the metal layer. Uniform heating is facilitated by making the metal layer concave and also by use of an inhomogeneous thickness of the metal layer to obtain the desired heat distribution. The invention also applies to the known "matrix" cathode wherein another application is made to the metal plate before applying the oxide layer.

The invention will be explained in greater detail with the aid of an embodiment example.

The directly heated oxide cathode shown schematically in the cross-section has a cylindrical outer conductor 1. In the latter, an inner conductor 2 is arranged coaxially. The inner conductor 2 is fastened to the outer conductor 1 by a ceramic support disc 3. A thin metal layer 4 preferably consisting of nickel is provided on one end face of the cathode, which metal layer 4 is soldered to the inner conductor 2 and the outer conductor 1. To the outside of the thin metal layer 4, an electron-emitting oxide layer 5, for instance, a barium oxide layer, is applied.

In case the cathode is a matrix cathode, nickel powder provided with a binder is sprayed and sintered onto the thin metal layer 4 which consists preferably of nickel. Subsequently, the emission compound (oxide layer 5) is applied. The inner conductor 2 and the outer conductor 1, which consist preferably of nickel or a nickel alloy, have thick walls so that they do not heat up if a large current flows through. The d-c current from the inner conductor 2 to the outer conductor 1 flows through the thin-walled cathode metal sheet (metal layer 4) and rapidly heats the latter. In this preferred embodiment example, the thin metal layer 4 is made concave and has an inhomogeneous wall thickness. By this measure, as well as by a suitable choice of the material for the inner and the outer conductor, a uniform temperature distribution of the cathode can be achieved.

The foregoing is a description corresponding, in substance, to German application No. P 33 23 473.6, dated June 29, 1983, international priority of which is being claimed for the instant application, and which is hereby made part of this application. Any material discrepancies between the foregoing specification and the specification of the aformentioned corresponding German application are to be resolved in favor of the latter.

We claim:

1. Directly heated oxide cathode, especially for velocity-modulated tubes in pulse operation, which comprises a cylindrical outer conductor, an inner conductor coaxially arranged within the cylindrical outer conductor, a ceramic support disc supporting and spacing the inner conductor from the outer conductor, a metal layer connected on one end face of the cathode to the outer conductor and the inner conductor, and an electron-emitting oxide layer disposed on the metal plate.

2. Cathode according to claim 1, wherein the metal layer as well as the inner conductor and the outer conductor consist of nickel or a nickel alloy.

3. Cathode according to claim 1, wherein the oxide layer is an alkali metal oxide layer or alkaline earth metal oxide layer.

4. Cathode according to claim 2, wherein the oxide layer is an alkali metal oxide layer or alkaline earth metal oxide layer.

5. Cathode according to claim 1, wherein the cathode is a matrix cathode.

6. Cathode according to claim 1, wherein the metal layer has an inhomogeneous wall thickness.

7. Cathode according to claim 2, wherein the metal layer has an inhomogeneous wall thickness.

8. Directly heated oxide cathode, especially for velocity-modulated tubes in pulse operation, which comprises a cylindrical outer conductor, an inner conductor coaxially arranged with the cylindrical outer conductor, a ceramic support disc supporting and spacing the inner conductor from the outer conductor, a metal layer connected on one end face of the cathode to the outer conductor and the inner conductor, and an electron-emitting oxide layer disposed on the metal layer wherein the metal layer is made concave.

9. Cathode according to claim 5, wherein the metal layer has an inhomogeneous wall thickness.

10. Directly heated oxide cathode, especially for velocity-modulated tubes in pulse operation, which comprises a cylindrical outer conductor, an inner conductor coaxially arranged within the cylindrical outer conductor, a creamic support disc supporting and spacing the inner conductor from the outer conductor, a metal layer connected on one end face of the cathode to the outer conductor and the inner conductor, and an electron-emitting oxide layer disposed on the metal layer, wherein the metal layer as well as the inner conductor and the outer conductor consist of nickel or a nickel alloy and wherein the metal layer is made concave.

11. Directly heated oxide cathode, especially for velocity-modulated tubes in pulse operation, which comprises a cylindrical outer conductor, an inner conductor coaxially arranged within the cylindrical outer conductor, a ceramic support disc supporting and spacing the inner conductor from the outer conductor, a metal layer connected on one end face of the cathode to the outer conductor and the inner conductor, wherein the metal layer is made concave and an electron-emitting oxide layer disposed on the metal layer wherein the oxide layer is an alkali metal oxide layer or alkaline earth metal oxide layer wherein the metal layer is made concave.

12. Directly heated oxide cathode, especially for velocity-modulated tubes in pulse operation, which comprises a cylindrical outer conductor, an inner conductor coaxially arranged within the cylindrical outer conductor, a ceramic support disc supporting and spacing the inner conductor from the outer conductor, a metal layer connected on one end face of the cathode to the outer conductor and the inner conductor, and an electron-emitting oxide layer disposed on the metal layer wherein the metal layer is substantially thinner-walled than the outer conductor and the inner conductor.

13. Directly heated oxide cathode, especially for velocity-modulated tubes in pulse operation, which comprises a cylindrical outer conductor, an inner conductor coaxially arranged within the cylindrical outer conductor, a ceramic support disc supporting and spacing the inner conductor from the outer conductor, a metal layer connected on one end face of the cathode to the outer conductor and the inner conductor, and an electron-emitting oxide layer disposed on the metal layer wherein the metal layer as well as the inner conductor and the outer conductor consist of nickel or a nickel alloy and wherein the metal layer is substantially thinner-walled than the outer conductor and the inner conductor.

14. Directly heated oxide cathode, especially for velocity-modulated tubes in pulse operation, which comprises a cylindrical outer conductor, an inner conductor coaxially arranged within the cylindrical outer conductor, a ceramic support disc supporting and spacing the inner conductor from the outer conductor, a metal layer connected on one end face of the cathode to the outer conductor and the inner conductor, and an electron-emitting oxide layer disposed on the metal layer wherein the metal layer is made concave and wherein the metal layer is substantially thinner-walled than the outer conductor and the inner conductor.

15. Directly heated oxide cathode, especially for velocity-modulated tubes in pulse operation, which comprises a cylindrical outer conductor, an inner conductor coaxially arranged within the cylindrical outer conductor, a ceramic support disc supporting and spacing the inner conductor from the outer conductor, a metal layer connected on one end face of the cathode to the outer conductor and the inner conductor, and an electron-emitting oxide layer disposed on the metal layer wherein the metal layer has an inhomogeneous wall thickness and wherein the metal layer is substantially thinner-walled than the outer conductor and the inner conductor.

16. Directly heated oxide cathode, especially for velocity-modulated tubes in pulse operation, which comprises a cylindrical outer conductor, an inner conductor coaxially arranged within the cylindrical outer conductor, a metal layer connected on one end face of the cathode to the outer conductor and the inner conductor, an electron-emitting oxide layer disposed on the metal layer and means for spacing the inner conductor from the outer conductor at a point beneath the metal layer.

* * * * *